US006856216B1

(12) United States Patent
Trosa et al.

(10) Patent No.: US 6,856,216 B1
(45) Date of Patent: Feb. 15, 2005

(54) SAMPLE-AND-HOLD PHASE SHIFTER CONTROL VOLTAGE DISTRIBUTION IN A PHASED ARRAY UTILIZING VOLTAGE-CONTROLLED PHASE SHIFT DEVICES

(75) Inventors: Ralph Trosa, Indialantic, FL (US); Robert W. Perry, Indialantic, FL (US); Neville Glyn Maycock, Jr., Palm Bay, FL (US); Joseph A. Elam, Palm Bay, FL (US); James M. Freebourn, Indian Harbour Beach, FL (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 10/679,767

(22) Filed: Oct. 6, 2003

(51) Int. Cl.[7] ..... H01P 1/18; H01Q 3/26

(52) U.S. Cl. ..... 333/156; 333/164; 342/372; 342/374; 343/778

(58) Field of Search ..... 333/156, 158, 333/164; 343/754, 778; 342/371–375

(56) References Cited

U.S. PATENT DOCUMENTS 4,652,883 A * 3/1987 Andricos ..... 342/372
5,309,166 A * 5/1994 Collier et al. ..... 343/778
6,559,798 B1 * 5/2003 Marumoto et al. ..... 342/372

* cited by examiner

*Primary Examiner*—Seungsook Ham
(74) *Attorney, Agent, or Firm*—Allen, Dyer, Doppelt, Milbrath & Gilchrist, P.A.

(57) ABSTRACT

A phase shift control voltage distribution scheme for a phased array utilizing voltage-proportional phase shift devices employs a digital-to-analog converter that supplies respectively different analog voltages to a sample-and-hold switch network coupled to analog voltage control inputs of the plurality of voltage-proportional phase shift devices. In order to impart a phase shift control voltage to one or more phase shift elements of the array, a control unit supplies a prescribed combination of a digital control code to the digital-to-analog converter and a switch control code to sample-and-hold switches of the switch network.

12 Claims, 1 Drawing Sheet

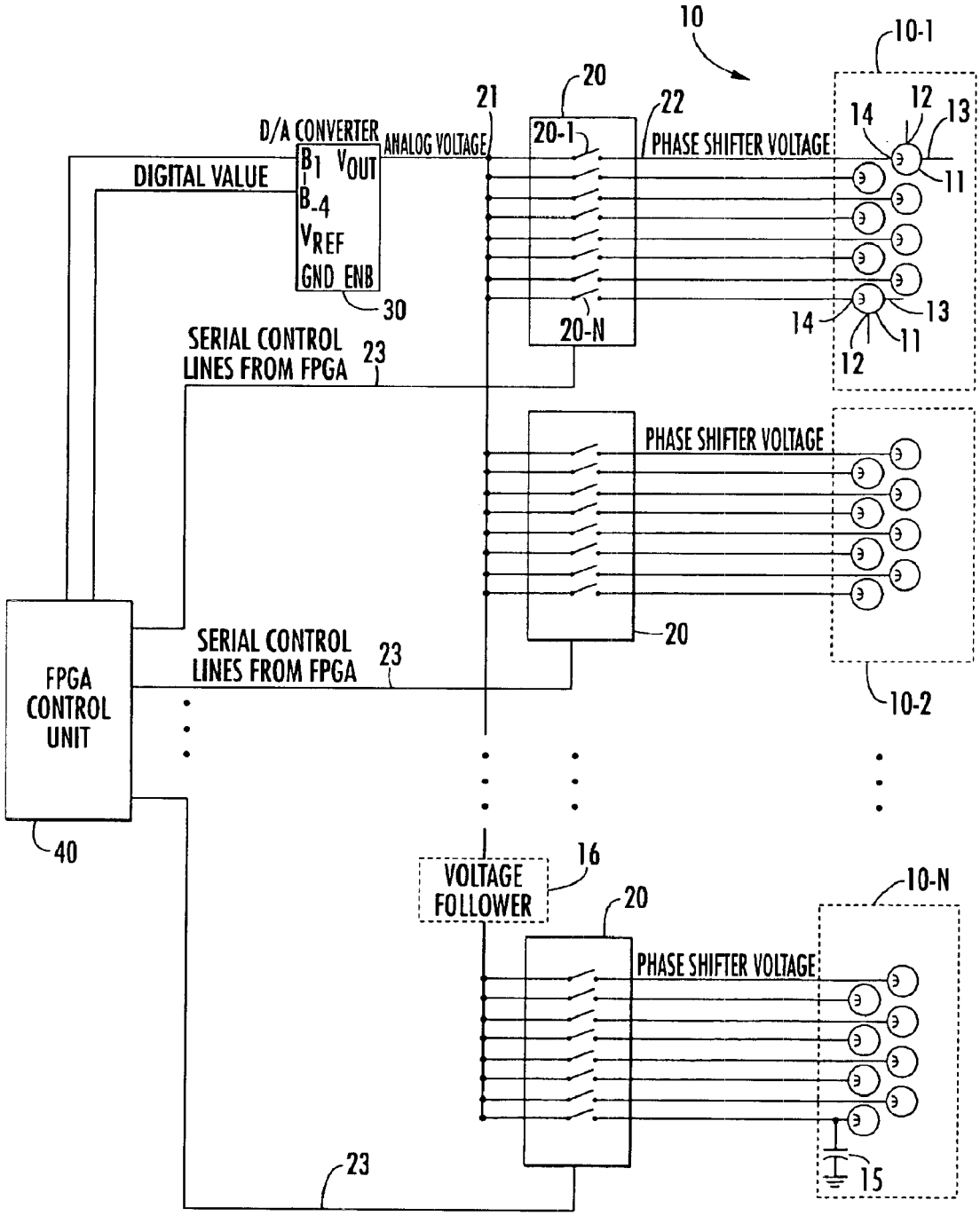
10
10-1
20
21
22
20-1
D/A CONVERTER
ANALOG VOLTAGE
PHASE SHIFTER VOLTAGE
DIGITAL VALUE
B1 VOUT
B-4
VREF
GND ENB
30
20-N
14
12
13
11
SERIAL CONTROL LINES FROM FPGA
23
PHASE SHIFTER VOLTAGE
20
10-2
FPGA CONTROL UNIT
40
VOLTAGE FOLLOWER
16
10-N
15

SAMPLE-AND-HOLD PHASE SHIFTER CONTROL VOLTAGE DISTRIBUTION IN A PHASED ARRAY UTILIZING VOLTAGE-CONTROLLED PHASE SHIFT DEVICES

GOVERNMENT LICENSE RIGHTS

The U.S. Government has a paid-up license in this invention and the right in limited circumstances to require the patent owner to license others on reasonable terms as provided for by the terms of contract No. DAAB07-03-3-L423, awarded by CECOM.

FIELD OF THE INVENTION

The present invention relates in general to communication systems and subsystems thereof, and is particularly directed to a phased array architecture, comprised of a plurality of analog voltage-proportional phase shift elements and a sample-and-hold control voltage distribution network coupled thereto. The sample-and-hold control voltage distribution network selectively couples the voltage output of a digital-to-analog converter to the control voltage input of one or more voltage-controlled phase shift elements that make up the phased array architecture, thereby producing whatever phase shift pattern is desired.

BACKGROUND OF THE INVENTION

In the course of development of communication systems and networks that operate at ever increasing frequencies (e.g., on the order of 1–50 GHz and above), the electronics industry continues to look for ways to decrease the cost of components of which such systems and networks are comprised. Because beam steerable and agile systems customarily employ phase shift components, their feed and control interconnect architecture layouts can be quite complex and costly to deploy. Thus, there is currently a need for low cost and reduced complexity phase shift architectures that are capable of operating and relatively high frequencies.

SUMMARY OF THE INVENTION

In accordance with the present invention advantage is taken of analog voltage-proportional phase shift components to implement a relatively low cost analog phased array architecture, that is configured to selectively couple the voltage output of a digital-to-analog converter to the voltage control input of one or more voltage-controlled phase shift elements that make up the phased array architecture, thereby producing whatever phase shift pattern is desired.

As will be described, the invention is configured of a spatially distributed array of voltage-controlled analog phase shift elements, such as tunable varactor components, dielectric elements or paraelectric components, such as ferro-electric devices. Each phase shift element has an input port to which a respective input signal is supplied, and an output port from which a phase-shifted output signal is obtained. The phase of the output signal is shifted in phase relative to the phase of the input signal in accordance with a control voltage supplied to a voltage control port thereof. Control voltages for defining the phase shift through each phase shift element are derived from a multiple analog voltage supply unit, configured as series of sample-and-hold switches that are selectively coupled to the output of a digital-to-analog converter.

In operation, all of the switches of the switching units are initially in their default open state. In order to impart a phase shift control voltage to one or more phase shift elements of the array, a control unit supplies a prescribed combination of a digital control code to the digital-to-analog converter and a switch control code to the sample-and-hold switches. The digital control code supplied to the digital-to-analog converter defines the magnitude of the control voltage and thereby the magnitude of phase shift to be produced by one or more phase shift elements to which that voltage is supplied by one or more of the switching units.

This also allows the control unit to compensate for non-linearities in any phase shift device. The switch control code supplied to the switching units specifies one or more of the phase shift elements to be programmed with the analog voltage output by the digital-to-analog converter. Once a respective programming voltage has been supplied to a phase shift element its associated switch within a respective switching unit is opened, to complete the hold condition for the phase shift element.

BRIEF DESCRIPTION OF THE DRAWINGS

The single FIGURE diagrammatically illustrates an embodiment of an analog voltage-proportional phase array architecture according to the present invention.

DETAILED DESCRIPTION

Before describing in detail the phased array architecture of the present invention, it should be observed that the invention resides primarily in a modular arrangement of conventional communication circuits and components and an attendant supervisory controller, that controls the operations of such circuits and components. In a practical implementation that facilitates their being packaged in a hardware-efficient equipment configuration, this modular arrangement may be implemented by means of analog voltage-proportional phase shift elements and an associated application specific integrated circuit (ASIC) chip set.

Consequently, the architecture of such arrangement of circuits and components has been illustrated in the drawings by a readily understandable block diagram, which shows only those specific details that are pertinent to the present invention, so as not to obscure the disclosure with details which will be readily apparent to those skilled in the art having the benefit of the description herein. Thus, the block diagram illustration is primarily intended to show the major components of the invention in a convenient functional grouping, whereby the present invention may be more readily understood.

Attention is now directed to the single FIGURE, which diagrammatically illustrates an embodiment of an analog voltage-driven phase array architecture according to the invention. As shown therein, the phased array proper comprises a spatially distributed arrangement 10 of respective sets 10-1, 10-2, . . . , 10-N of voltage-controlled analog phase shift elements 11, comprised of voltage-proportional devices, as referenced above. As a non-limiting example, a respective set 10 of phase shift elements may comprise eight phase shift elements, as shown.

Within an individual set of voltage-proportional phase shift elements, each phase shift element 11 has an RF input port 12, to which a respective input signal is supplied, and an RF output port 13 from which a phase-shifted output signal, that is shifted in phase relative to the input signal in accordance with a control voltage supplied to an analog control voltage input 14 thereof, is obtained. Control voltages for defining the magnitude of phase shift through the various phase shift elements are derived from an associated sample-and-hold switching unit 20, containing N controlled switches 20-1 through 20-N, where N=8 in the present example. Inputs 21 of the individual sample-and-hold switches of each of the switching units 20 are connected in common to the output of a digital-to-analog converter (DAC) 30, while outputs 22 thereof are coupled to respective ones of their associated set of phase shift elements. Each switching unit 20 is further coupled via a switch control bus 23 to a supervisory control unit 40, which is operative to define the phase shift pattern that is loaded into the phase shift elements of the array, as well as the digital input to the DAC.

The analog voltage-driven phase array architecture of the invention operates as follows. Initially all of the switches of the switching units are in their default open state, as shown. In order to impart a phase shift control voltage to one or more phase shift elements of the array, control unit 40 supplies a prescribed combination of a digital control code to the DAC 30 and a switch control code to the switching units 20. The digital control code supplied to the DAC 30 serves to define the magnitude of the control voltage delivered by the DAC and thereby the magnitude of phase shift to be produced by one or more phase shift elements to which that voltage is supplied by one or more of the switching units 20. This also allows the control unit 40 to compensate for non-linearities in any phase shift device. The switch control code supplied to the switching units 20 serves to specify which one or more of the phase shift elements is to be programmed with the analog voltage output by the DAC. Regardless of the programming scheme employed, once a respective programming voltage has been supplied to a phase shift element 11, its associated switch within a respective switching unit 20 is opened, to complete the hold condition for the phase shift element.

As a non-limiting example, the individual switches of the switching units may be closed one at a time (e.g., sequentially) and, with each switch closure, a control code supplied to the DAC so as to program that switch's associated phase shift element 11 with the phase shift produced by the analog voltage output by the DAC. As a more efficient programming routine, the DAC may be controlled so as to sequentially step through a series of codes that are effective to produce a ramp voltage at the output of the DAC. During this ramping of the DAC voltage, switch closure codes are produced on the control bus 23, so that one or more phase shift elements are supplied with the appropriate voltage produced by the DAC.

As an adjunct to the embodiment described above, auxiliary storage capacitors, one of which is shown in broken lines 15, may be employed to augment the holding voltage functionality of the phase shift elements. In addition, voltage follower circuits, such as that shown in broken lines 16, may be coupled with the inputs 21 to the sample-and-hold switching units 20 to extend the number of phase shift elements that may be driven by the DAC.

While we have shown and described an embodiment in accordance with the present invention, it is to be understood that the same is not limited thereto but is susceptible to numerous changes and modifications as known to a person skilled in the art. We therefore do not wish to be limited to the details shown and described herein, but intend to cover all such changes and modifications as are obvious to one of ordinary skill in the art.

What is claimed is:

1. A phase shift apparatus comprising:

a plurality of voltage-controlled analog phase shift elements to which respective input signals are supplied and from which phase-shifted output signals, shifted in phase relative to said input signals in proportion to analog voltages supplied to voltage control inputs thereof, are produced;

an analog voltage supply unit having an analog voltage output that is operative selectively produce respectively different analog voltages; and a sample-and-hold switching network, coupled between said analog voltage supply unit and said voltage control inputs of said plurality of voltage-controlled analog phase shift elements, and being operative to selectively couple different analog voltages produced by said analog voltage supply unit to said voltage control inputs of any of said plurality of voltage-controlled analog phase shift elements.

2. The phase shift apparatus according to claim 1, wherein a respective voltage-controlled analog phase shift element is comprised of a ferro-electric phase shift element.

3. The phase shift apparatus according to claim 1, wherein said analog voltage supply unit comprises a digital-to-analog converter.

4. The phase shift apparatus according to claim 3, wherein said sample-and-hold switching network comprises respective sets of sample-and-hold switching units having inputs thereof coupled to receive an analog voltage output of said digital-to-analog converter, outputs thereof coupled to analog voltage control inputs of said plurality of voltage-controlled analog phase shift elements, and control inputs thereof coupled to receive switching control signals in association with digital inputs to said digital-to-analog converter.

5. The phase shift apparatus according to claim 1, wherein said voltage-controlled analog phase shift elements include phase shift elements that are operative to produce phase shift outputs linearly proportional to analog voltages supplied to voltage control inputs thereof.

6. The phase shift apparatus according to claim 1, wherein said voltage-controlled analog phase shift elements include phase shift elements that are operative to produce phase shift outputs non-linearly proportional to analog voltages supplied to voltage control inputs thereof.

7. A method of imparting controlled phase shifts to a plurality input signals so as to produce phase-shifted output signals, that are shifted in phase relative to said input signals, said method comprising the steps of:

(a) coupling said respective ones of said plurality of input signals to respective ones of a plurality of analog voltage-controlled phase shift elements, which are operative to impart prescribed amounts of phase shift to input signals applied thereto in accordance with control voltages supplied to voltage control inputs thereof;

(b) providing an analog voltage supply unit having an analog voltage output that is operative selectively produce respectively different analog voltages;

(c) coupling a sample-and-hold switching network between said analog voltage supply unit and said voltage control inputs of said plurality of voltage-controlled phase shift elements; and (d) controlling the operation of said sample-and-hold switching network so as to couple different analog voltages supplied thereto by said analog voltage supply unit to voltage control inputs of selected ones of said plurality of voltage-controlled phase shift elements.

8. The method according to claim 7, wherein a respective analog voltage-proportional phase shift element comprises a ferro-electric phase shift element.

9. The method according to claim 7, wherein said analog voltage supply unit comprises a digital-to-analog converter.

10. The method according to claim 9, wherein said sample-and-hold switching network comprises respective sets of sample-and-hold switching units having inputs thereof coupled to receive an analog voltage output of said digital-to-analog converter, outputs thereof coupled to analog voltage control inputs of said plurality of analog voltage-controlled phase shift elements, and control inputs thereof coupled to receive switching control signals in association with digital inputs to said digital-to-analog converter.

11. The method according to claim 7, wherein said analog voltage-controlled phase shift elements include phase shift elements that are operative to produce phase shift outputs linearly proportional to analog voltages supplied to voltage control inputs thereof.

12. The method according to claim 7, wherein said analog voltage-controlled phase shift elements include phase shift elements that are operative to produce phase shift outputs non-linearly proportional to analog voltages supplied to voltage control inputs thereof.

* * * * *

UNITED STATES PATENT AND TRADEMARK OFFICE

CERTIFICATE OF CORRECTION

PATENT NO. : 6,856,216 B1 
DATED : February 15, 2005
INVENTOR(S) : Ralph Trosa et al.

It is certified that error appears in the above-identified patent and that said Letters Patent is hereby corrected as shown below:

Column 4,
Line 58, delete "of voltage-" insert -- of analog voltage- --
Line 64, delete "of voltage-controlled" insert -- of analog voltage-controlled --
Line 66, delete "voltage-proportional" insert -- voltage-controlled --

Signed and Sealed this

Thirty-first Day of May, 2005

JON W. DUDAS
*Director of the United States Patent and Trademark Office*